US012275544B2

(12) United States Patent
Dumontel

(10) Patent No.: US 12,275,544 B2
(45) Date of Patent: Apr. 15, 2025

(54) METHOD OF MANUFACTURING A PACKAGE FOR FLAT PLATES AND BLANK FOR SAID PACKAGE

(71) Applicant: SMART CONVERTING S.R.L., Modena (IT)

(72) Inventor: Luigi Dumontel, Modena (IT)

(73) Assignee: SMART CONVERTING S.R.L., Modena (IT)

( * ) Notice: Subject to any disclaimer, the term of this patent is extended or adjusted under 35 U.S.C. 154(b) by 730 days.

(21) Appl. No.: 17/419,521

(22) PCT Filed: Dec. 23, 2019

(86) PCT No.: PCT/IB2019/061261
§ 371 (c)(1),
(2) Date: Jun. 29, 2021

(87) PCT Pub. No.: WO2020/141403
PCT Pub. Date: Jul. 9, 2020

(65) Prior Publication Data

US 2022/0081140 A1 Mar. 17, 2022

(30) Foreign Application Priority Data

Dec. 31, 2018 (IT) ..... 102018000021466

(51) Int. Cl.
*B65B 11/00* (2006.01)
*B65B 23/20* (2006.01)
(Continued)

(52) U.S. Cl.
CPC ..... *B65B 11/004* (2013.01); *B65B 23/20* (2013.01); *B65B 43/10* (2013.01); *B65B 51/02* (2013.01); *B65D 5/5035* (2013.01); *B65D 85/46* (2013.01)

(58) Field of Classification Search
CPC ..... B65B 11/004; B65B 23/20; B65B 43/10; B65B 51/02; B65D 5/5035; B65D 85/46
See application file for complete search history.

(56) References Cited

U.S. PATENT DOCUMENTS 4,759,495 A * 7/1988 Moon ..... B65D 5/32 229/101
2018/0229909 A1* 8/2018 Ruini ..... B65D 81/058
2019/0039762 A1* 2/2019 Toro ..... B65B 59/001

FOREIGN PATENT DOCUMENTS

DE 29806902 6/1998
EP 2 952 437 12/2015
(Continued)

OTHER PUBLICATIONS

International Search Report for PCT/IB2019/061261, mailed Feb. 25, 2020, 4 pages.
(Continued)

*Primary Examiner* — Andrew M Tecco
*Assistant Examiner* — Nicholas E Igbokwe
(74) *Attorney, Agent, or Firm* — NIXON & VANDERHYE

(57) ABSTRACT

A blank and a package are disclosed as well as a manufacturing method thereof of a package for flat plates, including: producing a foldable flat blank made of a packaging material; folding the flat blank to form a box-shaped package with open closable flaps; introducing the flat plates into the box-shaped package and closing the closable flaps; in the production step of the flat blank the following steps being further provided: supplying a web of the wrapping material to a punching and sorting unit to obtain strips parallel to a travel direction; punching and separating elongated modular pieces from the strips; folding flat to an L-shape the elongated modular pieces, bringing them close in pairs in correspondence of respective ends; fastening the modular
(Continued)

pieces folded to an L-shape in correspondence of the respective ends, forming the blank in the shape of a quadrangular frame.

20 Claims, 5 Drawing Sheets

(51) Int. Cl.

| | |
|---|---|
| ***B65B 43/10*** | (2006.01) |
| ***B65B 51/02*** | (2006.01) |
| ***B65D 5/50*** | (2006.01) |
| ***B65D 85/46*** | (2006.01) |

(56) References Cited

FOREIGN PATENT DOCUMENTS

| | | | | | |
|---|---|---|---|---|---|
| EP | 2952437 | A1 * | 12/2015 | ..... | B65B 11/585 |
| WO | 2016/156928 | | 10/2016 | | |
| WO | WO-2016156928 | A1 * | 10/2016 | ..... | B65B 23/00 |
| WO | 2017/051274 | | 3/2017 | | |
| WO | 2017/149422 | | 9/2017 | | |

OTHER PUBLICATIONS

Written Opinion of the ISA for PCT/IB2019/061261, mailed Feb. 25, 2020, 6 pages.

* cited by examiner

Foto 1

Foto 2

Foto 3

METHOD OF MANUFACTURING A PACKAGE FOR FLAT PLATES AND BLANK FOR SAID PACKAGE

This application is the U.S. national phase of International Application No. PCT/IB2019/061261 filed 23 Dec. 2019, which designated the U.S. and claims priority to IT Patent Application No. 102018000021466 filed 31 Dec. 2018, the entire contents of each of which are hereby incorporated by reference.

Please replace the original specification with the attached substitute specification. In accordance with 37 C.F.R. § 1.125(b), the undersigned registered Patent Attorney hereby states that the substitute specification contains no new matter.

BACKGROUND OF THE INVENTION

Field of the Invention

The present invention relates to a method of manufacturing a package for flat plates, a blank for such package and a manufacturing apparatus thereof, in particular a method of manufacturing packages or boxes for the wrapping of flat plates, such as tiles, stone slabs, glass panes, laminate sheets and so on.

Description of the Related Art

In industrial lines dedicated to packaging by means of paper boxes, product units are packaged within cardboard boxes traditionally obtained from bending of die cut cardboard. It is currently in the paper industry that the die cutting technique has widespread dramatically, allowing to have identical and accurate cuts of special and complex shapes of paper, cardboard and similar materials.

The blank cardboard is typically obtained as a flat tray with suitably shaped contour, through die curring or the operation, according to the specific box size. On the flat punched tray a creasing operation along specific lines, is practised, which allows an even and accurate folding of the flat material, due to the pressing of the paper or of the cardboard along the predetermined folding lines.

In the last few years, in the packaging of flat products for the building industry, in particular tiles, the use is generally accepted of an alternative technique to the use of boxes deriving from a traditional die cutting technology. As a matter of fact, it has been verified that, unlike the material to be packaged in bulk, the flat sheet material in piles, for example sheets, laminates and tiles, does not technically require a full containment box: it is sufficient to have a packaging which mutually consolidates the various pile sheets, protecting only the sides and the edges thereof. This allows a significant part of box cardboard to be saved, which would otherwise cover the sheet or tile surface, with no significant function.

This technology uses cardboard bands, which are suitably cut and shaped within a highly complex packaging line, within which a cardboard bandage or containment frame is built around the tile pile.

Examples of this technology are illustrated for example in EP2952437, WO2016156928 and WO2017149422.

The frame system represents a valid alternative to replace the traditional tray-shaped cardboard, obtaining non-negligible advantages not only in terms of savings of raw material, but also of easy size adaptability, hence with resulting in a dramatic reduction of obsolescences and stocks of cardboard in the warehouse.

However, the perimeter bandaging apparatuses of tiles have a remarkable intrinsic complexity—because they must create a full wrapping starting from very simple cardboard bands and they must simultaneously move along the line a series of heavy piles of tiles, around which the bandage is built—which makes them rather expensive. Moreover, they fully replace any traditional boxing lines (that is, those using classic die-cut trays) preexisting in the factories, thus implying the unpleasant dismantling of previous investments.

The need is therefore felt to have a packaging method and an apparatus therefor capable of balancing the advantages peculiar of perimeter framing with the relative savings of material and size adaptability, with the opportunity of not wasting the investments already made for the conventional boxing equipment.

SUMMARY OF THE INVENTION

The object of the present invention is therefore to offer a solution which solves the above-cited problems and supplies a method and an apparatus for obtaining a simple and effective system for producing a package for stacked flat plates, which allows significant material saving with respect to classic wrapping boxes, but which exploits at least in part traditional packaging machines which use pre-punched trays.

Such object is achieved according to the invention by means of a production method of packages for stacks of flat plates, such as tiles, having the features disclosed and claimed. Other preferred features of the invention are also disclosed and claimed.

BRIEF DESCRIPTION OF THE DRAWINGS

Further features and advantages of the invention will in any case be more evident from the following detailed description of a preferred embodiment, given as a non-limiting example and illustrated in the attached drawings, wherein:

FIG. 4A is a pictorial top plan view of an exemplifying die-cut piece of cardboard obtained with the method of the invention, while

DETAILED DESCRIPTION OF THE PREFERRED EMBODIMENT

In a system for the packaging of flat plates, such as tiles, a traditional boxing line is advantageously used, in a manner known per se, wherein a flat blank is folded and glued to form a box, into which a stack of flat plates is inserted before being suitably closed. For such purpose, a boxing line comprises at least a folding apparatus, a filling unit and a closing system of the upper flaps.

However, according to the invention, one or more traditional boxing lines are not supplied with classic punched trays but are preceded by an original blank creation line, which is disclosed in detail in the following.

Figure 1:
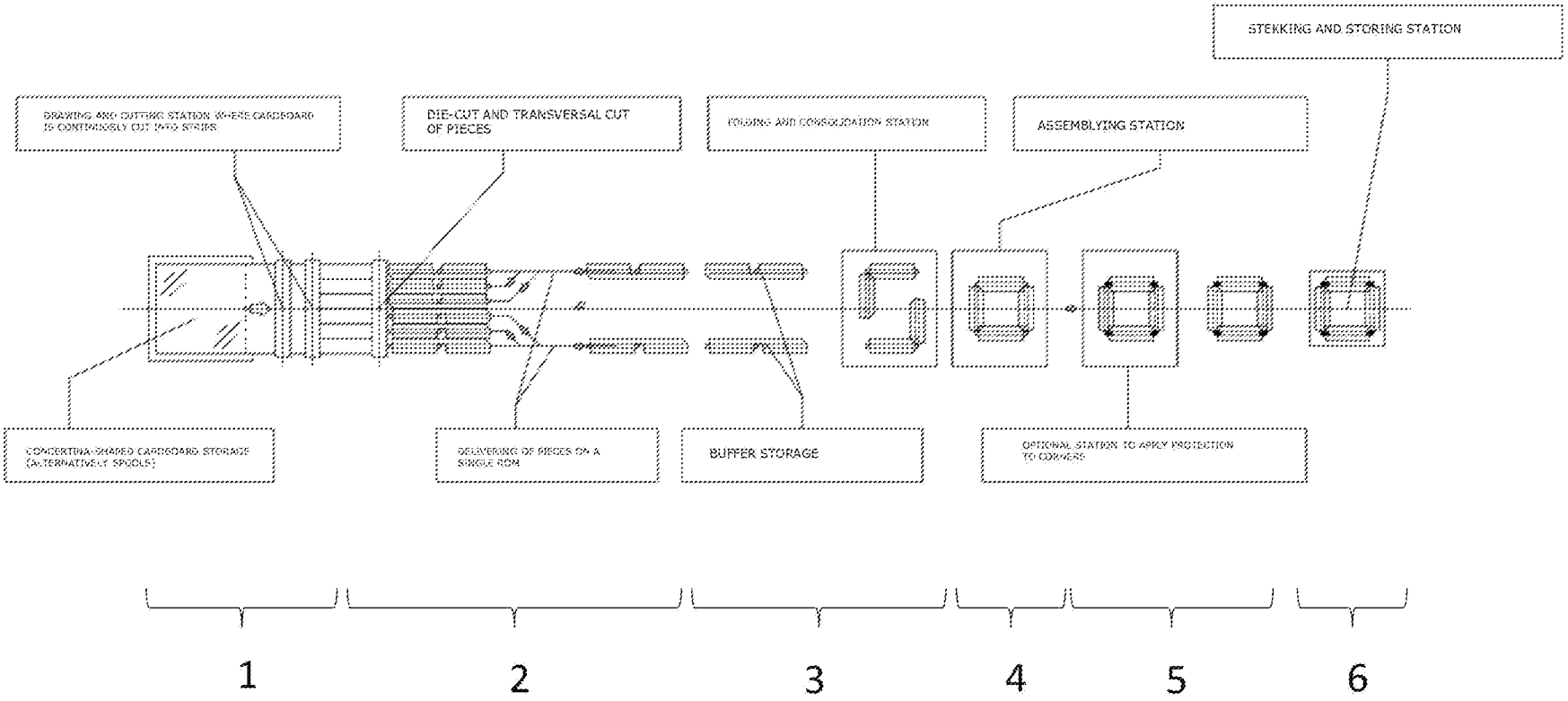
FIG. 1 is a schematic top plan view of a production line of packaging blanks according to the present invention.
Figure 2:
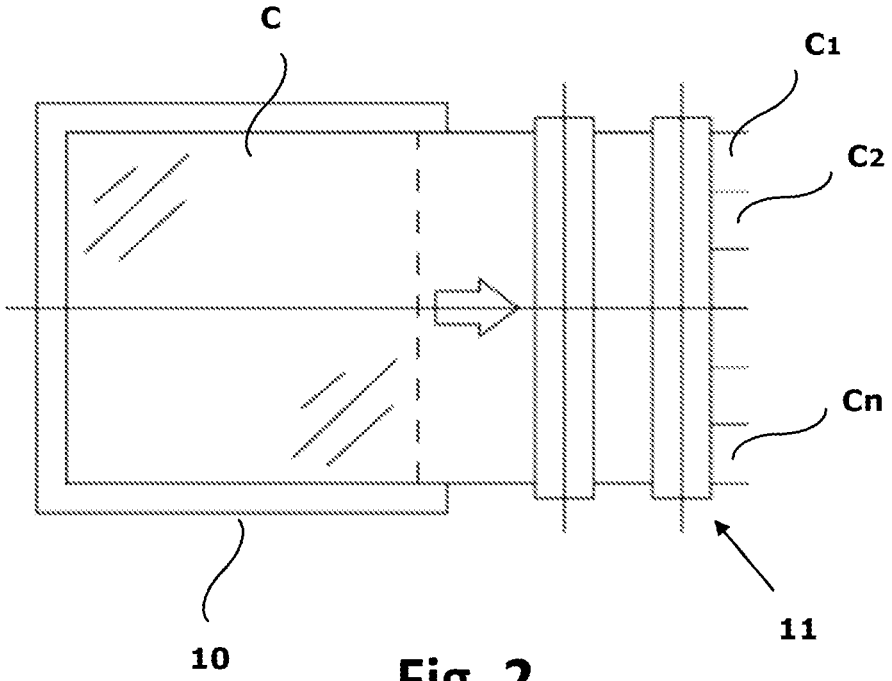
FIG. 2 is a view of a detail of FIG. 1, which shows an unwinding and continuous longitudinal cutting station.

The blank creation line according to the invention, as clearly highlighted in FIG. 1, comprises a plurality of staggered stations, meant to create a flat blank having an original layout, usable in a traditional boxing line, starting from flat material of a standard shape, such as paper rolls or sheets of a suitable thickness, smooth cardboard, corrugated cardboard or the like.

In a first drawing and unwinding station 1, semi-finished flat wrapping material C, for example thin corrugated cardboard, arranged in a supply units 10 in concertina-shaped piles or in spools, is drawn and delivered to a line conveyor to be processed.

In case the material is made available in the form of separate stacked sheets, downstream of drawing station 1 a joining station (not shown) is possibly provided, which has the function of serially joining two or more sheets by gluing, using for example vinyl or hot-melt glue: such operation has the purpose of obtaining a continuous flow of material, if necessary. In this case, a pressure section is possibly provided in the machine to perform a local compression of the flat material, to reduce the thickness of the overlapping areas on the leading and trailing edge of the individual sheets.

Just downstream the drawing thereof and possible joining of the sheets in continuous, the flat cardboard material is cut in a longitudinal cutting unit 11. In this step, the continuous web of material is divided into a plurality of strips $C_1$-$C_n$ of desired width, preferably an even number of strips $C_n$, for example six strips of even width. The width of strips $C_1$-$C_n$ can be defined as desired, for example changing the distance between axles of cutting knives provided in this station.

Subsequently, the flat semi-finished material divided in strips $C_1$-$C_n$ is processed in a punching and sorting station 2. In such station a die-cut is provided, possibly assisted by a transversal knife unit (not shown), which detaches from continuous strips $C_1$-$C_n$ a plurality of modular bands or pieces, suitably shaped $P_1$-$P_n$ of desired length. The length of modular pieces $P_1$-$P_n$ is easily changeable by changing the pace of intervention of the die-cut during the continuous sliding movement of flat material C along the line and/or the pace of intervention of the transversal knives which separate the individual pieces from the continuous material.

Preferably an operation of definition of folding lines is also performed at the same time, for example by creasing or by cutting short rectilinear discontinuous incisions, along predefined lines on pieces $P_1$-$P_n$, to ease the folding of pieces $P_1$-$P_n$, in particular along longitudinal lines and an oblique line in a centreline area which divides into two parts each piece.

Figure 4A:
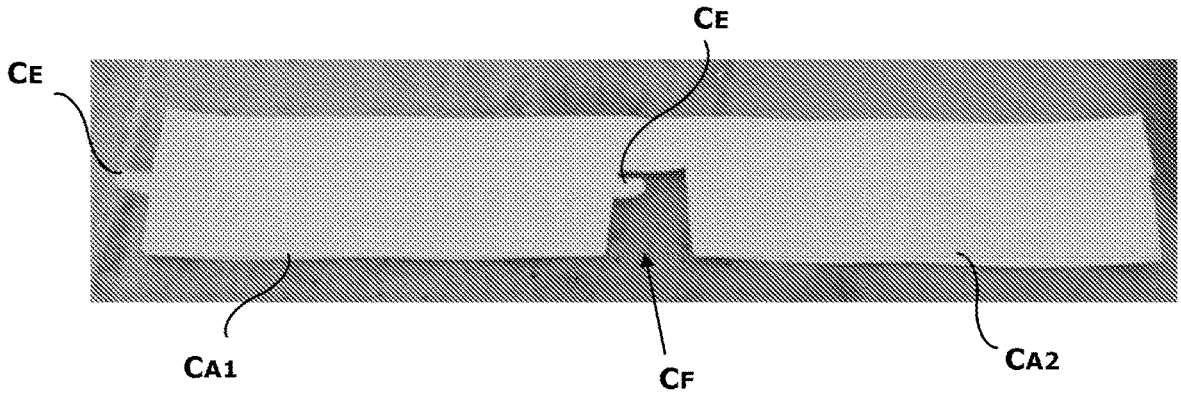
Figure 4B:
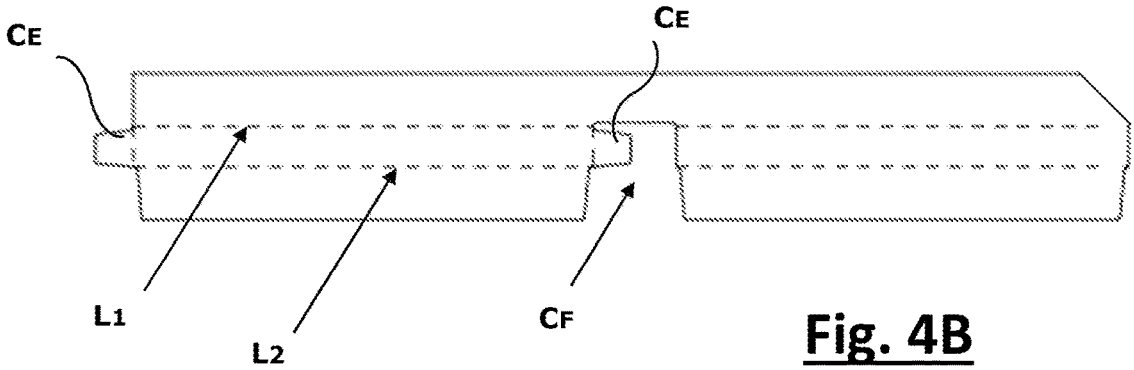
FIG. 4B is a schematic top plan view of another exemplifying die.

The preferred shape of the individual modular pieces $P_1$-$P_n$ (as shown in FIGS. 4A and 4B) provides a general rectangular shape, with a wide rectangular cut-out $C_F$ at around middle length of the piece, which spans across from the longitudinal edge up until exceeding the centreline longitudinal axis of the modular piece. The rectangular cut-out $C_F$ ideally divides modular piece $C_n$ into two opposite branches $C_{A1}$ and $C_{A2}$, of a length proportional to the two sides of the flat plates to be packaged.

From one $C_{A1}$ of the two opposite branches, two opposite appendixes or flaps $C_E$ project, substantially extending on the longitudinal centreline axis of the modular piece.

Figure 3:
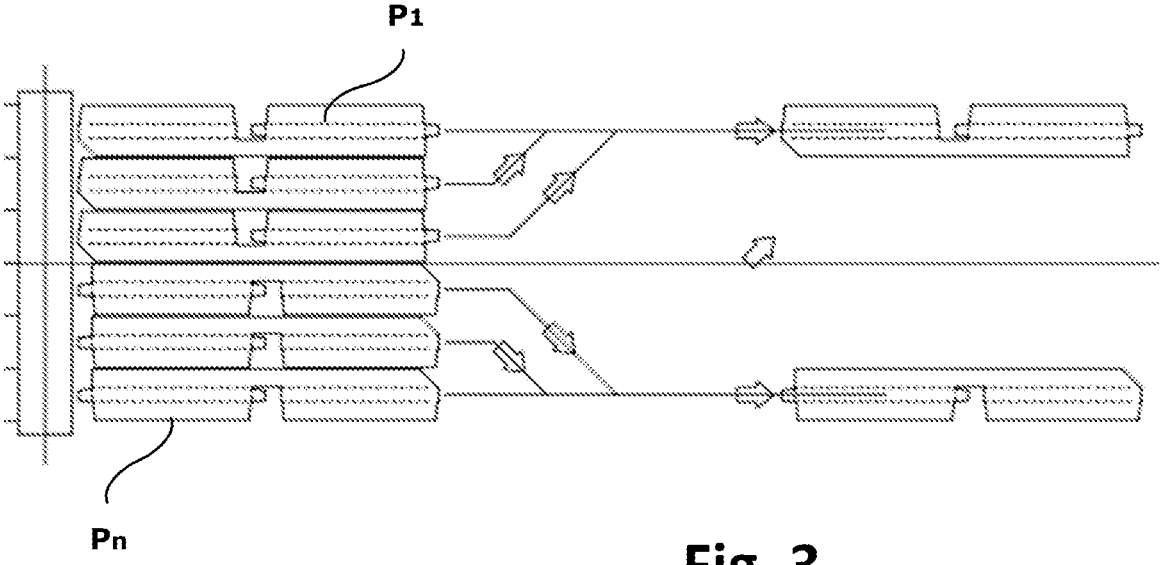
FIG. 3 is a view of another detail of FIG. 1, which shows a punching and marshalling station.

In the cutting operation which occurs in punching station 2, strips $C_1$-$C_n$ are shaped with the shape of the individual modular pieces (FIGS. 4A and 4B), preferably operating so as to apply a specific pattern for half of the modular pieces arranged on one side of the longitudinal axis of the line and a specular pattern on the other half of the modular pieces arranged symmetrically on the other side of the longitudinal axis of the line (as shown in the detail of FIG. 3).

At the end of punching, the modular pieces are then drawn in specular pairs, $P_1P_n$, $P_2P_{n-1}$, $P_3P_{n-2}$ . . . , and arranged in two advancement rows along a delivering line (see the right-hand side part in FIG. 3). In substance, all modular pieces $P_1$-$P_n$ are sorted on only two advancement rows, keeping them side by side in specular pairs, meant to cooperate in a complementary way.

Possibly a printing station (not shown) is provided along the advancement row, wherein a printing machine is located which applies writings, logos and other graphic representations on the individual modular pieces.

Downstream of punching and sorting station 2, the individual modular pieces are possibly collected, outside of the advancement row, in a supplementary buffering area (left hand-side part of FIG. 5), where suitable accumulators are located for storing these pieces waiting to be used in the subsequent processing unit. An operating processing module is then prepared for the re-introduction of specular and complementary pairs of modular pieces with the suitable pace to the subsequent processing unit.

In a consolidation station 3, the pairs of complementary modular pieces $P_1$-$P_n$ are processed in a folding unit 31. In particular, each modular piece is then folded along an oblique line, at about 45°, arranged in a middle area corresponding to cut-out $C_F$, so as to bring the two opposite branches $C_{A1}$ and $C_{A2}$ of each piece $P_n$, from a longitudinally aligned condition to an orthogonal relative attitude, that is, at 90° one with respect to the other (as highlighted in FIG. 5).

The folding line, as seen above, can be previously determined with a creasing or discontinued incision.

The folding is performed so that the cut-out part $C_F$ remains open towards the outside of the angle formed by the two branches $C_{A1}$ and $C_{A2}$ of each piece $P_n$.

Figure 5:
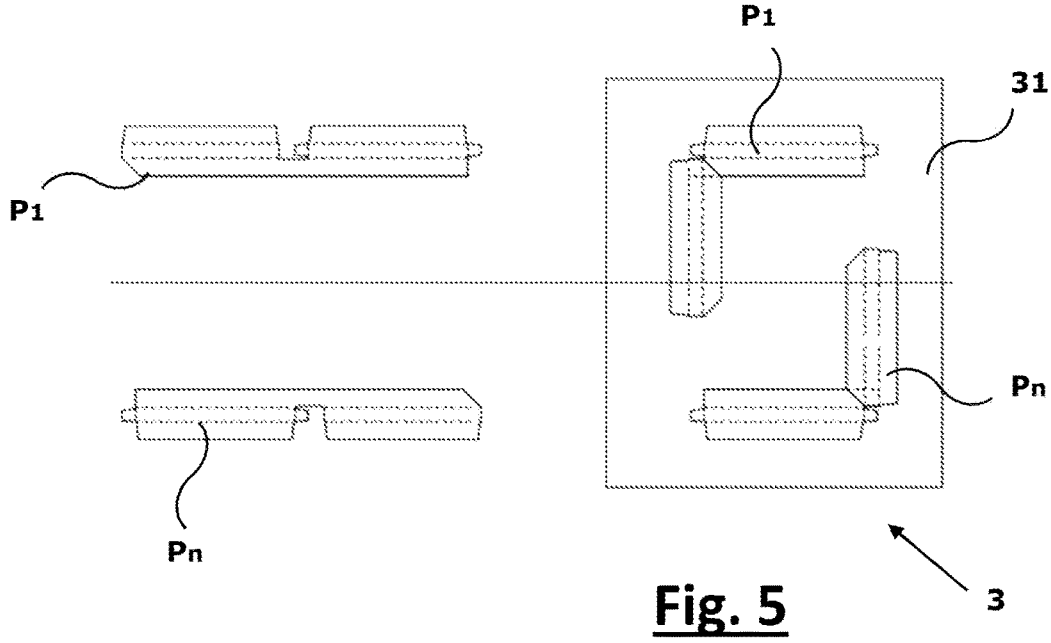
FIG. 5 is a view of another detail of FIG. 1, which shows a folding and preparation station of the individual pieces.

Each of the modular pieces takes on an L-shaped profile and since they have previously been arranged in specular pairs, they end up in complementary L-shaped pairs as shown in FIG. 5. They are hence arranged to be placed next to each other in correspondence of the respective ends to form an ideal quadrangular frame.

The two complementary modular pieces $P_1$ and $P_n$, after having been put next to each other, and possibly partly overlapped, in correspondence of the respective two ends, are then securely fastened in an assembling and consolidation station 4.

Figure 6:
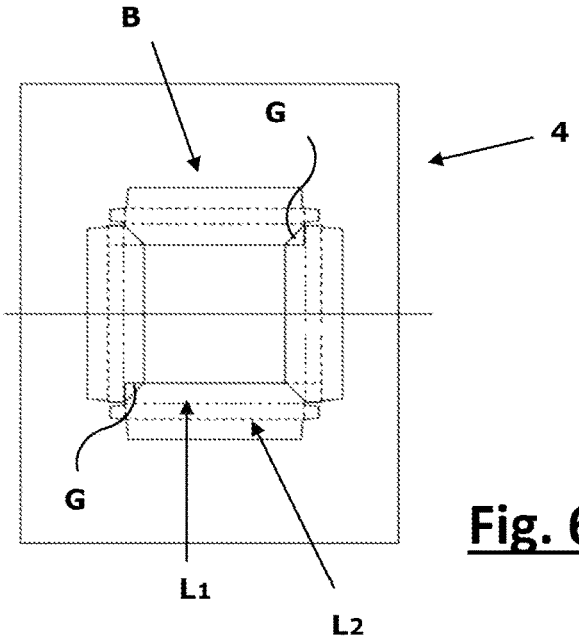
FIG. 6 is a view of another detail of FIG. 1, which shows an assembling and gluing station of the blank.

The fastening between the two L-shaped, modular pieces typically occurs by gluing of the mutual ends, in the points referred to as G in FIG. 6, in ways known in the field, preferably by means of hot-melting so that the consolidation of the adhesive occurs in a short time following cooling.

As can be clearly understood also from the representation of FIG. 6, the two modular, mutually welded pieces form a final blank B very similar to a traditional tray-shaped die, wherein, however, only a rectangular frame is defined, having an open window in the middle. The size of the blank can be easily adjusted by changing in line the width and the length of the two branches $C_{A1}$ e $C_{A2}$ of the modular piece.

The final blank B forms a quadrangular flat frame of a semi-finished material, for example corrugated cardboard, preferably provided with (creased or engraved) longitudinal folding lines apt to subsequently perform the required folding. For example, two folding lines $L_1$ and $L_2$ are provided, practised in punching and sorting station 2, along which each side of the blank frame can be subsequently folded a first time, at 90°—to define a perimeter edge for containing the package—then a second time at 180°—for defining a package closing flap.

Figure 7:
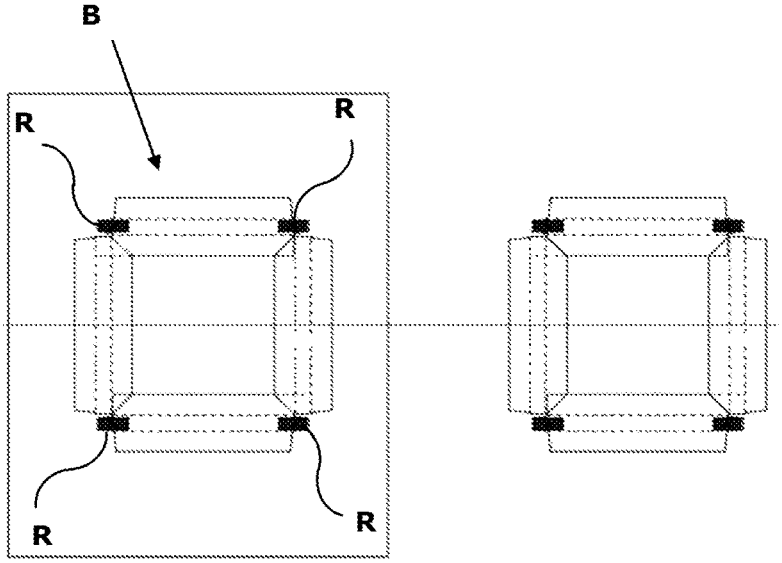
FIG. 7 is a view of another detail of FIG. 1, which shows an application station where angular protections are applied.
Figure 8:
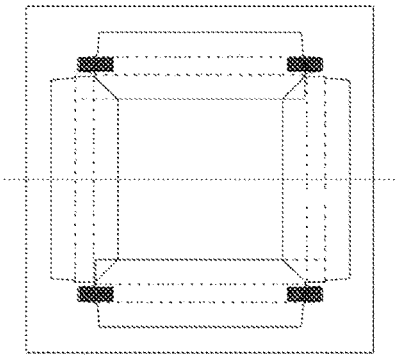
FIG. 8 is a view of another detail of FIG. 1, which shows a stacking and storing station.

A further finishing station 5 (FIG. 7) is possibly provided wherein additional package protections are applied. In particular, at the vertexes of rectangular blank B—in the proximity of the position in which the blank material has a triangular cut-out, deriving from the folding of the modular pieces around cut-outs $C_F$—elements or patches R of padding and protective material may be applied, for example polyurethane or polystyrene plates. Patches R are joined to the cardboard material by gluing, stapling, or other similar system.

These angular protections are meant to remain within the package, abutting against the corners of the flat plates to be packaged, hence performing a protective function with respect to impacts.

Finally, blank B is sent to a stacking and storing station 6.

At this point, blanks B are available to be supplied to conventional boxing line, wherein it is folded to form a box-like package, filled with a stack of plates and/or tiles and then closed exploiting predetermined closing lines $L_1$ and $L_2$.

Figure 9:
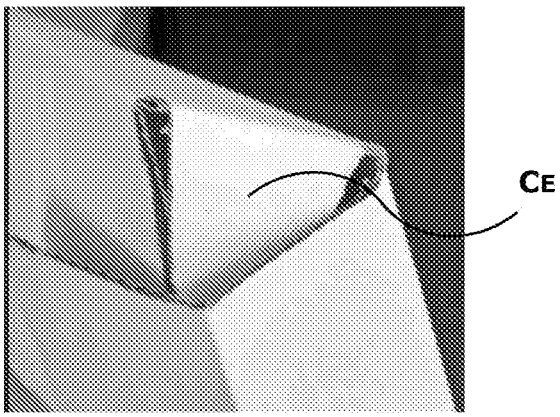
FIG. 9 is a pictorial view of three representative photographs of three folding steps of angular closing flaps.
Figure 9:
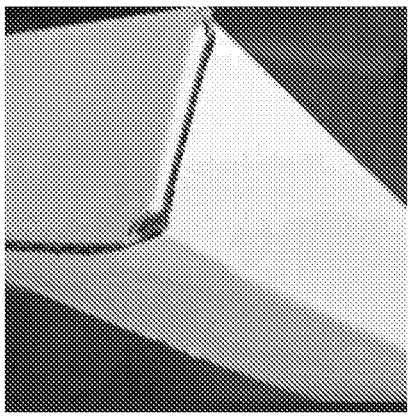
Figure 9:
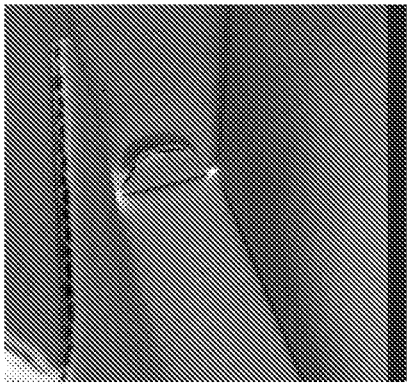

In the folding step of this box-like package, flaps $C_E$ are possibly also exploited to make a tuck-in between the side flanks, while defining an angular closure and an inner reinforcement area which protects the corners of the packaged material (see photographs 1-3 in FIG. 9).

The resulting box-like package, in actual fact covers and consolidates the contents thereof (that is, the stack of plates) mainly along the side edges and the corners, as well as short perimeter bands on the top and bottom surfaces of the stack, however, leaving uncovered a large part of the greater surface of the plates, saving package material.

In the following the full packaging process is briefly described for greater clarity, according to the method of the present invention.

In a first step of the packaging operations, unless one must operate with standard products, the measurement of a stack of flat plates for example a batch of tiles to be packaged is detected. Based on these measurements, the production of a plurality of blanks B is started by the production line illustrated in FIG. 1, adjusting the cutting length and width of bands $C_1$-$C_n$, as well as the position of cut-outs $C_F$, determining hence the absolute and relative length of the two opposite branches $C_{A1}$ and $C_{A2}$.

The production of resulting blanks B is started and ended when stacking station 6 has received an amount thereof sufficient to package the provided batch.

After that, flat blanks B are introduced into the feeder of a conventional boxing line, where they are folded to form a box-shaped package wherein the flat plates are then laid, before closing the package.

As can be inferred from the description reported here above, the solution proposed by the invention perfectly achieves the objects set forth in the premises.

The production method of the package uses a continuous sheet semi-finished material, obtaining tray-shaped blanks sized and adjusted according to the requirements of the batch to be packaged, which makes the need for storage for each specific box size superfluous.

The blank which is obtained is specifically conceived for packaging stacked solid products, where the need for packaging is limited to consolidate the various stacked pieces and protect the thin edges thereof, making covering the major surfaces of the stack superfluous, where as a matter of fact the package is devoid of material to the benefit of saving costs.

Moreover, advantageously, the production line supplies a blank perfectly compatible with the conventional boxing lines which employ tray-shaped pre-cut blanks: that represents a significant safeguard of the investments already made by tile industries, since the production line of the blank may be assisted by already existing boxing machinery and does not replace it. Moreover, the fact that the flat plates are not transferred onto the packaging line, results in a lighter, cheaper and faster production line.

However, it is understood that the invention must not be considered limited to the particular arrangements illustrated above, which represent only exemplifying embodiments thereof, but that different variants are possible, all within the reach of a person skilled in the field, without departing from the scope of protection of the invention, which is defined exclusively by the following claims.

For example, the shape of the individual modular pieces may also differ from the illustrated one, to adjust to specific requirements both concerning the type of the product to be packaged, and of the conventional boxing line employed.

Finally, although reference has always been made to the packaging of stacks of flat plates, it is not ruled out that the method may be used also for packaging stacks of other large-surface products (hence which do not require containment walls as far products in bulk), for example dishes (also of a concave surface) or variously shaped slabs.

The invention claimed is:

1. Manufacturing method of a package for flat plates, comprising the steps of:

producing a foldable flat blank of a wrapping material, folding said flat blank to form a box-shaped package with open closable flaps, and introducing said flat plates into said box-shaped package and closing said closable flaps, wherein said step of producing a flat blank comprises the steps of supplying a web of said wrapping material to a punching and cutting unit to obtain strips parallel to a travel direction, punching and separating from said strips a plurality of elongated modular pieces, folding flat into an L-shape said elongated modular pieces, bringing said elongated modular pieces close in pairs in correspondence of respective ends, and fastening said modular pieces folded to an L-shape in correspondence of the respective ends, forming said blank in the shape of a quadrangular frame.

2. The method as in claim 1, wherein said step of fastening the modular pieces folded to an L-shape in correspondence of the respective ends provides a gluing step.

3. The method of claim 2, wherein a step of defining longitudinal folding lines on said elongated modular pieces is furthermore provided before said step of folding into an L-shape.

4. The method of claim 2, further comprising a step of applying additional protections in the proximity of vertexes of said rectangular blank, said protections being arranged on a side meant to remain inside the package.

5. The method of claim 1, wherein said folding operation provides that each modular piece is folded along an oblique line, at about 45°, arranged in a middle area, so as to bring two opposite branches of each modular piece, from a longitudinally aligned condition to an orthogonal relative orientation.

6. The method of claim 5, wherein a step of defining longitudinal folding lines on said elongated modular pieces is furthermore provided before said step of folding into an L-shape.

7. The method of claim 5, further comprising a step of applying additional protections in the proximity of vertexes of said rectangular blank, said protections being arranged on a side meant to remain inside the package.

8. The method of claim 5, wherein said step of punching a plurality of elongated modular pieces provides to shape said modular pieces substantially into a rectangular shape with a wide rectangular cut-out ($C_F$) in a middle area, which span across from a side edge until the rectangular cutout overcomes a longitudinal centreline axis of said modular pieces, said rectangular cut-out dividing said two opposite branches having respective lengths proportional to the sides of a flat plate to be packaged.

9. The method of claim 8, wherein said folding step is performed so that the cut-out part remains open towards the outside of the angle formed by the two branches of each modular piece.

10. The method of claim 9, wherein a step of defining longitudinal folding lines on said elongated modular pieces is furthermore provided before said step of folding into an L-shape.

11. The method of claim 8, wherein a step of defining longitudinal folding lines on said elongated modular pieces is furthermore provided before said step of folding into an L-shape.

12. The method of claim 8, further comprising a step of applying additional protections n the proximity of vertexes of said rectangular blank, said protections being arranged on a side meant to remain inside the package.

13. The method of claim 8, wherein from one of said opposite branches two opposite flaps project, substantially extending on the longitudinal centreline axis of said modular pieces.

14. The method of claim 13, wherein said folding step is performed so that the cut-out part remains open towards the outside of the angle formed by the two branches of each modular piece.

15. The method of claim 13, wherein a step of defining longitudinal folding lines on said elongated modular pieces is furthermore provided before said step of folding into an L-shape.

16. The method of claim 13, further comprising a step of applying additional protections in the proximity of vertexes of said rectangular blank, said protections being arranged on a side meant to remain inside the package.

17. The method of claim 1, wherein a step of defining longitudinal folding lines on said elongated modular pieces is furthermore provided before said step of folding into an L-shape.

18. The method of claim 1, further comprising a step of applying additional protections in the proximity of vertexes of said rectangular blank, said protections being arranged on a side meant to remain inside the package.

19. Flat blank for the production of a box-shaped package, consisting of a pair of elongated modular pieces, folded to an L-shape and fastened in correspondence of the respective ends to form a quadrangular frame.

20. The blank of claim 19, wherein said elongated modular pieces are of a substantially rectangular shape with a wide rectangular cut-out in a middle area, which spans across from a side edge until overcoming a longitudinal centreline axis of said modular pieces, said rectangular cut-out dividing the elongated modular pieces into two opposite branches having a length proportional to the sides of flat plates to be packaged.

* * * * *